US008121790B2

(12) United States Patent
Kimminau et al.

(10) Patent No.: US 8,121,790 B2
(45) **Date of Patent: *Feb. 21, 2012**

(54) COMBINING RESERVOIR MODELING WITH DOWNHOLE SENSORS AND INDUCTIVE COUPLING

(75) Inventors: Stephen J. Kimminau, Sudbury (GB); George Albert Brown, Beaconsfield (GB); John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 509 days.

This patent is subject to a terminal disclaimer.

(21) Appl. No.: 12/333,343

(22) Filed: Dec. 12, 2008

(65) Prior Publication Data

US 2009/0182509 A1 Jul. 16, 2009

Related U.S. Application Data

(63) Continuation-in-part of application No. 11/571,829, filed on Nov. 27, 2007, now Pat. No. 7,778,780.

(51) Int. Cl.
*G01V 1/40* (2006.01)
*G01F 1/12* (2006.01)

(52) U.S. Cl. ..... 702/11; 702/6; 702/100

(58) Field of Classification Search ..... 702/6, 11, 702/12, 45, 50, 127, 130, 136, 189, 100; 703/2, 6, 9; 324/323, 324; 73/152.13, 152.33, 73/152.37; 166/250.1, 250.02, 250.05, 250.15, 166/276, 278, 279; 175/40, 50

See application file for complete search history.

(56) References Cited

U.S. PATENT DOCUMENTS 3,011,342 A 12/1961 Simm
3,913,398 A 10/1975 Curtis
4,559,818 A 12/1985 Tsang et al.

(Continued)

FOREIGN PATENT DOCUMENTS

GB 2395315 A 5/2004

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

(Continued)

*Primary Examiner* — John H Le

(74) *Attorney, Agent, or Firm* — Brandon S. Clark; Rodney Warfford

(57) ABSTRACT

A method is disclosed of characterizing a well using a series of measurements taken along the sandface of that well in order to optimize a well model. The method may comprise providing a well model with a plurality of adjustable physical parameters, providing a data set made up of a plurality of sandface measurements, and running the well model with different combinations of adjustable physical parameters so that the results of the well model substantially match the results of the sandface measurements. In one embodiment, the method may comprise creating a communication pathway between the surface and the sandface including an inductive coupler. A further step may include pre-processing the plurality of the sandface measurements. In addition, a further step may be to establish or set at least one control device in order to change the flow characteristics of the production fluid in the well.

20 Claims, 2 Drawing Sheets

U.S. PATENT DOCUMENTS

| | | | |
|---|---|---|---|
| 4,597,290 | A | 7/1986 | Bourdet et al. |
| 4,733,729 | A | 3/1988 | Copeland |
| 4,850,430 | A | 7/1989 | Copeland et al. |
| 4,969,523 | A | 11/1990 | Martin et al. |
| 5,871,047 | A | 2/1999 | Spath et al. |
| 5,992,519 | A | 11/1999 | Ramakrishnan et al. |
| 6,076,046 | A | 6/2000 | Vasudevan et al. |
| 6,310,559 | B1 | 10/2001 | Laborde et al. |
| 6,614,716 | B2 | 9/2003 | Plona et al. |
| 6,618,677 | B1 | 9/2003 | Brown |
| 6,668,922 | B2 | 12/2003 | Ziauddin et al. |
| 6,675,892 | B2 | 1/2004 | Kuchuk et al. |
| 6,749,022 | B1 | 6/2004 | Fredd |
| 6,776,256 | B2 | 8/2004 | Kostyuchenko et al. |
| 6,789,937 | B2 | 9/2004 | Haddad et al. |
| 6,857,475 | B2 | 2/2005 | Johnson |
| 6,942,033 | B2 | 9/2005 | Brooks et al. |
| 6,980,940 | B1 | 12/2005 | Gurpinar et al. |
| 7,114,557 | B2 | 10/2006 | Cudmore et al. |
| 7,165,618 | B2 | 1/2007 | Brockman et al. |
| 7,243,718 | B2 | 7/2007 | Chen et al. |
| 7,294,636 | B2 | 11/2007 | Cumming et al. |
| 7,308,941 | B2 | 12/2007 | Rolovic et al. |
| 7,337,839 | B2 | 3/2008 | Ayoub et al. |
| 7,340,384 | B2 | 3/2008 | Delhomme et al. |
| 7,380,600 | B2 | 6/2008 | Willberg et al. |
| 7,434,619 | B2 | 10/2008 | Rossi et al. |
| 7,448,448 | B2 | 11/2008 | Lovell et al. |
| 2005/0115741 | A1 | 6/2005 | Terry et al. |
| 2005/0149264 | A1 | 7/2005 | Tarvin et al. |
| 2006/0077757 | A1 | 4/2006 | Cox et al. |
| 2007/0162235 | A1* | 7/2007 | Zhan et al. ..... 702/6 |
| 2007/0213963 | A1 | 9/2007 | Jalali et al. |
| 2007/0271077 | A1 | 11/2007 | Kosmala et al. |
| 2008/0065362 | A1 | 3/2008 | Lee et al. |
| 2008/0201080 | A1 | 8/2008 | Lovell et al. |
| 2009/0095469 | A1* | 4/2009 | Dozier ..... 166/250.01 |
| 2009/0182509 | A1 | 7/2009 | Kimminau et al. |

FOREIGN PATENT DOCUMENTS

| | | | |
|---|---|---|---|
| GB | 2401430 | A | 11/2004 |
| GB | 2408327 | A | 5/2005 |
| WO | 9850680 | A2 | 11/1998 |
| WO | 9850680 | A3 | 2/1999 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

L Saputelli et al. "Real-Time Decision-making for Value Creation while Drilling" SPE/IADC Middle East Drilling Technology Conference & Exhibition, Oct. 2003.

Lanier et al. "Brunei Field Trial of a Fibre Optic Distributed Temperature Sensor(DTS) System in 1,DOOm Open Hole Horizontal Oil Producer" SPE 84324; SPE Annual Technical Conference and Exhibition, Oct. 5-8, 2003.

* cited by examiner

COMBINING RESERVOIR MODELING WITH DOWNHOLE SENSORS AND INDUCTIVE COUPLING

CROSS-REFERENCE TO RELATED APPLICATION

The present application is a continuation-in-part of U.S. patent application Ser. No. 11/571,829, filed Nov. 27, 2007, which is a 371 of PCT Application No. PCTGB05/02110, filed May 27, 2005, (hereafter "the '829 application"), which claims priority from GB Application No. 0416871.2, filed Jul. 29, 2004, which is incorporated herein by reference.

BACKGROUND OF THE INVENTION

1. Field of the Invention

The present invention generally relates to well characterization, and, more particularly, to characterization of a well using a series of measurements from sensors deployed along the sandface of that well to optimize a well model. Such a well may, for example, be a production well that can be exploited to produce oil and/or gas.

2. Description of the Prior Art

The following descriptions and examples are not admitted to be prior art by virtue of their inclusion in this section.

Substantial work has been undertaken by the oil and gas industry to obtain information that can be used to determine physical parameters that characterize wells. One such effort has resulted in monitoring equipment which can detect when problems occur during fluid extraction from a well and which warn an operator of an abnormal operating condition. Several types of monitoring equipment using various techniques for measuring physical parameters that characterize wells are known. For example, the temperature profile of a well is a physical parameter that can provide an operator with useful information to characterize the well. One technique to obtain a temperature profile employs a downhole optical fiber acting as a distributed temperature sensor.

A drawback to the use of monitoring equipment is that the equipment tends to provide an indication of the abnormal condition once the event has already occurred. This type of monitoring equipment only enables the operator to provide a reactive response to the abnormal operating condition and may not provide an accurate indication of exactly where in the well the cause of the abnormal condition lies.

In the '829 application, a method is disclosed for characterizing a well using distributed temperature sensor data to optimize a well model. The method comprises the steps of providing a well model of thermal and flow properties of a well where the well model has a plurality of adjustable physical parameters. A data set made up of a plurality of distributed temperature sensor data profiles is provided where the profiles are taken at different times during the operation of the well. This method further comprises the step of running the well model with different combinations of the plurality of adjustable physical parameters to match the plurality of distributed temperature sensor data profiles.

It would be advantageous to provide a method of characterizing a well utilizing parameters other than downhole temperatures. This new and useful result is one of many stated and unstated results achieved by the method of the present invention.

SUMMARY OF THE INVENTION

In accordance with embodiments of the present invention, a method is provided for characterizing a well using a series of measurements deployed along the sandface of that well in order to optimize a well model. This method comprises the step of providing a well model with a plurality of adjustable physical parameters and providing a data set made up of a plurality of measurements along the sandface of a wellbore. A method according to an embodiment of the present invention further comprises the step of running the well model with different combinations of the plurality of adjustable physical parameters in order to match the plurality of sandface measurements.

In one embodiment of the present invention, the series of measurements may be distributed temperature measurements made along an optical fiber. In another embodiment of the present invention, the well may contain a communication device from the surface to the sandface and data regarding downhole parameters is transmitted to the surface by utilizing an inductive coupling technique. Such downhole parameters may, for example, include, but are not limited to, temperature, pressure, flow rate, fluid density, reservoir resistivity, oil/gas/water ratio, viscosity, carbon/oxygen ratio, acoustic parameters and chemicals sensing. In yet another embodiment of the present invention, the downhole measurements may be obtained by using a sensor string in combination with an optical fiber.

In another illustrative embodiment, a method according to aspects of the present invention may comprise the step of pre-processing the plurality of sandface measurements in order to make them consistent with one another. A method may, for example, but not limited to, include the pre-processing step of depth correction or of noise reduction. In other embodiments, a noise reduction step may advantageously be carried out by using a median filter.

In another illustrative embodiment, a method according to aspects of the present invention may comprise combining sensor data, downhole flow control devices and a surface modeling package. In such an embodiment, the flow control devices may be activated in a way so as to change the flow along the wellbore. That change may provide additional information that can be used to further increase the understanding of the reservoir. In the case of a multilateral well, for example, only one of the branches may be allowed to flow at any given time. By way of further example different chokes settings could be applied to change the flow distribution along a long horizontal well, and the settings of the flow control devices would be passed to the modeling device.

The measured data may also be used to further enhance the wellbore or reservoir modeling. For example, given a series of different flow rates in a wellbore, an optimal match between synthetic and measured data may only be possible through the use of a particular choice of friction along the wellbore. That value of friction may then be used in subsequent modeling runs.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. In the accompanying drawings.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations of and modifications from the described embodiments may be possible. The following description is thus intended to illustrate and not to limit the present invention.

As used here, the terms "up" and "down"; "upper" and "lower"; "upwardly" and "downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate. Additionally, the term "sandface" is utilized to refer to that part of the wellbore which penetrates through a hydrocarbon bearing zone.

Figure 1:
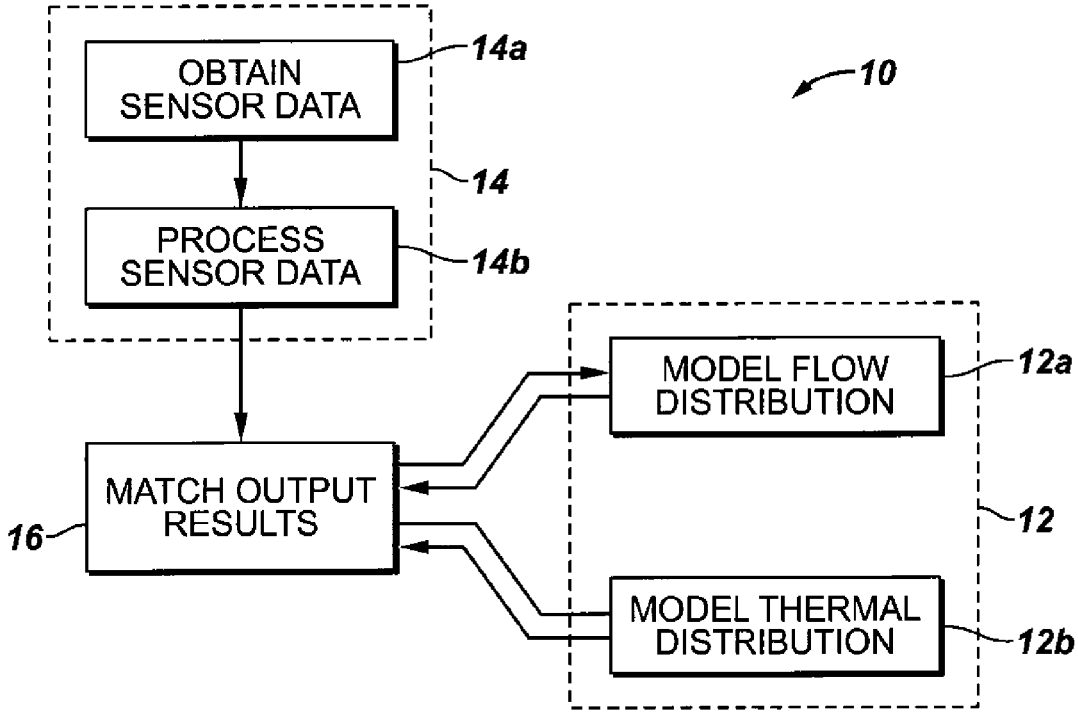
FIG. 1 is a flow diagram that illustrates a method using distributed wellbore data to optimize a well model according to one embodiment of the present invention.

Referring to FIG. 1, flow diagram 10 illustrates an embodiment of a method for characterizing a well using sandface sensor data in order to optimize a well model. The method comprises operating a well model 12 so as to model thermal and flow distributions in a well. The well may, for example, be a gas and/or oil producing well, such as that illustrated schematically in FIG. 16A of the '829 application. The well model may be operated in either steady-state or transient conditions. In the first stage 12*a*, the flow distribution in the well is modeled using a steady-state model. During the second stage 12*b*, the thermal distribution in the well is modeled using a transient flow model.

The well model 12 may model the whole well, and not just a reservoir interval using a transient model. The well model 12 may perform a nodal pressure analysis to calculate fluid properties and use Joule-Thomson calculations to more accurately model temperature effects in the near well region.

In one embodiment, the information necessary to set-up the thermal and flow models is provided to a data processing apparatus by a user/operator via a GUI, such as that described in the '829 application. The GUI may provide a sequence of data input screen images that the user can interact with in order to assign various values to various data fields. The GUI methodically guides the user through a data input process in order to obtain the necessary information. Use of such a GUI may simplify data entry and enable the user to apply an embodiment of a method of the invention without requiring detailed expert knowledge.

Once the thermal and flow distributions in the well have been modeled, sandface sensor data may be imported and conditioned, using the process at stage 14. Data may be obtained at stage 14*a*, for example, from real-time sandface sensor measurements and/or from one or more sandface sensor profiles that have already been acquired. One advantage of various embodiments of the present invention is that a plurality of sandface sensor profiles can be used to provide improved accuracy and to aid event prediction and parameter determination. Large amounts of historical sandface sensor data may be used in order to further improve the accuracy of the match between the sandface sensor profiles and the modeled thermal properties of the well.

The sandface sensor profile data may be pre-processed at stage 14*b* in order to make the sandface sensor profiles consistent with one another. The pre-processing may enable non-systematic noise variations, which may otherwise appear between the individual sandface sensor profiles, to be reduced. At stage 16, the output of the well model 12 may be matched with the sandface sensor profiles. This matching may, for example, be done by minimizing the root-mean-square difference between the modeled and sandface sensor-derived traces. However, any of a number of numerical techniques may be employed which are well known in the field of data analysis for parameter determination.

If it is detected that the output of the well model 12 does not adequately match the sandface sensor profiles, the physical parameters of the well model 12 may be adjusted and the well model run again in order to provide a new model of the thermal and flow properties of the well. The process of matching, adjusting the physical parameters, and running of the model may continue in an iterative manner until a sufficiently accurate match between the sandface sensor profiles and the output of the well model 12 is obtained, or until it is determined that no satisfactory match can be found.

When a match is obtained, the results of the sandface sensor profiles and the modeled thermal and/or flow data can be provided to a user. The matched data may indicate to the user the location and magnitude of various physical parameters that characterize the well, and make it easier for the user to spot where any anomalies or unusual characteristics occur. Matched data can also be recorded, thereby enabling the monitoring of various physical parameters to be observed and compared over a period of time.

In one embodiment of the present invention, the sensor data may, for example, be obtained from a spoolable array of sensors such as those disclosed in U.S. Provisional Application No. 60/866,622 by Dinesh Patel, filed Nov. 21, 2006, which is also incorporated herein by reference. Such a spoolable array of sensors may be deployed along the sandface, and the sensors may transmit data to the earth's surface via an inductive coupling technique. Data respecting such, but not limited to, downhole parameters as temperature, pressure, flow rate, fluid density, reservoir resistivity, oil/gas/water ratio, viscosity, carbon/oxygen ratio, acoustic parameters and chemical sensing may be communicated to the earth's surface.

Figure 2:
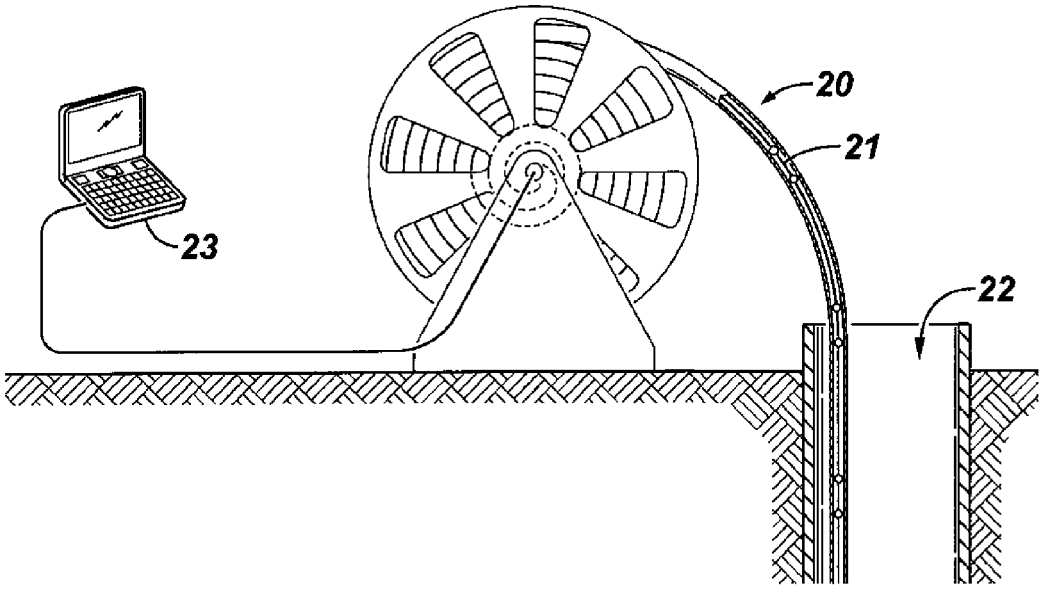
FIG. 2 is a pictorial diagram illustrating a system including communication apparatus and a sensor string for obtaining distributed wellbore data for use with a method in accordance with an embodiment of the present invention.

With reference now to FIG. 2, in yet another embodiment the sensor data from a sandface in wellbore 22 may also be obtained by using a spoolable array 20 comprising a plurality of addressable temperature sensors 21 that are deployed downhole and which may be addressed by communication apparatus 23 located at the earth's surface. When addressed, an addressable temperature sensor 21 may provide information respecting the individual temperature sensor's 21 identity and the temperature at the sensor's location downhole to the communication apparatus 23. Such an array of spoolable temperature sensors is disclosed in U.S. patent application Ser. No. 11/767,908, by Pete Howard et al., filed Jun. 25, 2007 which is also incorporated herein by reference.

Figure 3:
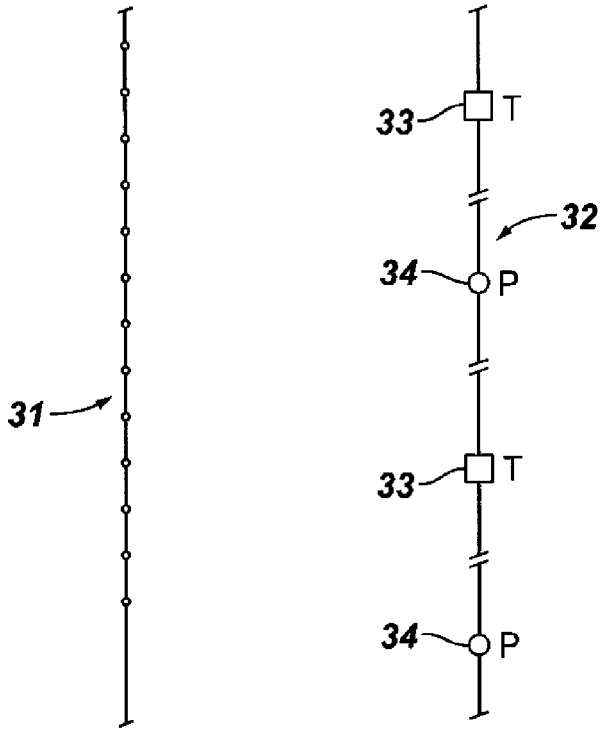
FIG. 3 is a pictorial drawing illustrating the combination of a sensor string and an optical fiber which are deployed downhole for obtaining distributed wellbore data for use with a method in accordance with an embodiment of the present invention.

With reference now to FIG. 3, in a further embodiment of the present invention, the sensor data from a sandface in a wellbore may be obtained by simultaneously deploying a fiber-optic cable 31 and sensor cable 32 into the wellbore. The sensor cable 32 may, for example, comprise a plurality of temperature sensors 33 and a plurality of pressure sensors 34 that are disposed at spaced intervals along the sensor cable 32. The spaced intervals for the pressure sensors 34 may, for example, be 20 meters. Distributed temperature sensor data may be obtained from fiber-optic cable 31 at one meter intervals, for example.

The sensor data obtained by sandface measurements may be preprocessed in a number of ways. For example, the sensor data received may include noise that must be reduced or otherwise removed. Such removal may, for example, be effected through the utilization of median and mean filters configured to remove spikes that may be present in the received sandface data. Such filtering techniques are well-known to those skilled in the art.

Yet another pre-processing step that may be required as one of depth control. Determination of the position of sensors deployed in the completion has been dependent upon surface measurements made as the completion is run into the ground. However, this measurement is sometimes incorrect. Even when correct, this surface measurement may not account for any compression or tension in the completion, potentially changing the length of the completion as it is deployed. In one embodiment of the present invention, sensors that are deployed downhole may be equipped with a small radioactive source. After deployment of the completion, a future run of wireline or coiled tubing can be made with a sensor configured to detect the presence of the radioactive source. The corrected depth of the sensor may then be established from the wireline or coiled tubing depth. Alternatively, radio frequency identification tags may be used, among other methods, and these tags may have an advantage of being coded with a serial number, etc. for further identification and confirmation of an individual sensor source position.

Figure 4:
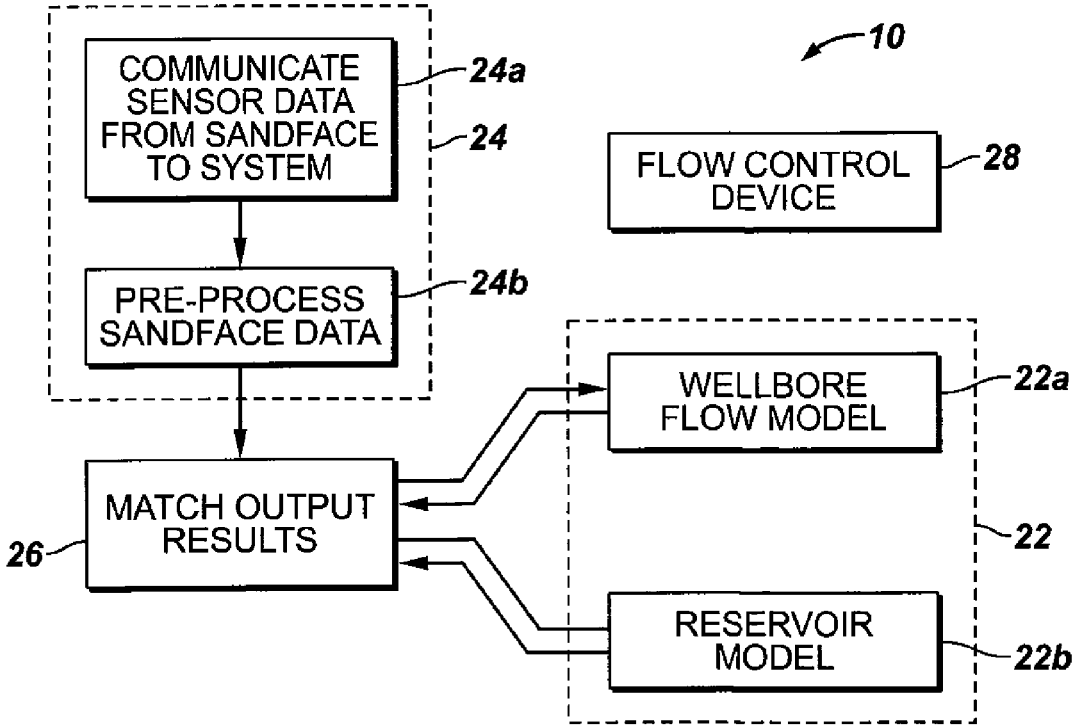
FIG. 4 is a flow diagram that illustrates using sandface sensor data to optimize a well model according to one embodiment of the present invention.

With reference now to FIG. 4, when a broader range of sensors beyond fiber optic cable is desired to be used, it may be necessary to use a more diverse modeling package then that described in FIG. 1. For example, rather than decoupling the flow properties in the wellbore from the thermal properties in the reservoir, as in an embodiment of the method illustrated in FIG. 1, a single modeling package such as wellbore flow model 22*a* may be used to model both properties. For example, one such package used to implement wellbore flow model 22*a* is the Eclipse program available from the Assignee of the present application.

Once the flow of distribution in the well has been modeled, sandface sensor data may be imported and conditioned using the process at stage 14, with data obtained at stage 14*a* from real-time sandface sensor measurements and/or from one or more sandface sensor profiles that have already been acquired. The sandface sensor profile data may be pre-processed at stage 24*b* so as to make the profiles consistent with one another. The pre-processing may utilize any of the pre-processing techniques described above, in addition to other equivalent techniques. At stage 26, the output of wellbore flow model 22*a* may be matched with the sandface sensor profiles. If it is determined that the output of wellbore flow model 22*a* does not adequately match the sandface sensor profiles, the physical parameters of the well model 22*a* may be adjusted and the well model run again to provide a new model of the flow properties of the well.

With reference still to FIG. 4, in one embodiment of a method of characterizing a well according to the present invention, a reservoir model 22*b* may be generated concerning the reservoir properties around the wellbore including but not limited to pressure, skin, permeability, and porosity. In this embodiment, the downhole sensors may provide information concerning the reservoir properties. Once the reservoir model has been constructed, the reservoir data from the sensors may be imported, pre-processed and matched against the output of reservoir model 22*b*. If it is determined that the output of reservoir model 22*b* does not adequately match the reservoir profiles provided by the sensors, the parameters of the reservoir model 22*b* may be adjusted and the reservoir model run again. The process of matching, adjusting the physical parameters, and running the model may continue in an iterative manner until a sufficiently accurate match between the reservoir data from the sensors and the output of the reservoir model is obtained or until it is decided that no satisfactory match can be found.

While still referring to FIG. 4, an embodiment of a method according to the present invention may further comprise the step of establishing at least one control device 28 to change the flow characteristics of the production fluid in the well. Flow control device 28 may, for example, be set at the earth's surface and may comprise a choke, among other types of flow control devices. Alternatively, the flow control device 28 may be set in the wellbore with an active or adjustable flow control device. Active or adjustable flow control devices may be controlled through either well interventions such as with wireline or coil tubing or be interventionless and controlled automatically or through a well communication system. In the case of a multilateral well, for example, the flow control devices 28 may be set such that only one branch in the well is allowed to flow at any given time. By way of further example, different chokes settings could be applied to change the flow distribution along a long horizontal well. In such cases, the settings of the flow control devices 28 could be provided to the modeling device.

A method according to this embodiment may include the steps of providing a data set made up of a plurality of sandface measurements. In addition, a well model may be provided with a plurality of adjustable physical parameters. The method may further include running the well model with different combinations of the plurality of adjustable physical parameters in order to match the plurality of the sandface measurements. Thereafter, the setting of the flow control devices 28 may be changed resulting in the altering of the flow distribution of the production of the well. At which time, the steps of running the well model and comparing the well model results to the sandface data may be repeated and the process used to redefine the well model.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method of characterizing a well using a series of measurements along the sandface of said well to optimize a well model, comprising:

providing a well model with a plurality of adjustable physical parameters;

providing a data set made up of a plurality of sand face measurements;

running the well model on a data processing apparatus with different combinations of the plurality of adjustable physical parameters to match the plurality of sand face measurements; and outputting results from running the well model.

2. The method of claim 1 wherein the series of measurements are distributed temperature measurements made along an optical fiber.

3. The method of claim 1 further comprising:

establishing a communication pathway between the surface and the sandface via a communication device.

4. The method of claim 3 wherein the communication pathway includes at least one inductive coupler.

5. The method of claim 1 further comprising:

automated pre-processing of the plurality of sandface measurements.

6. The method of claim 5 wherein the automated pre-processing step includes correcting for depth.

7. The method of claim 5 wherein the automated pre-processing step includes reducing sandface measurement noise.

8. The method of claim 7 wherein the sandface measurement noise is reduced via a median filter.

9. The method of claim 1 wherein the well model includes a model of temperature and flow properties.

10. The method of claim 1 wherein the step of providing a well model comprises providing a reservoir model.

11. The method of claim 1 wherein the well is one of multiple wells within a reservoir.

12. The method of claim 1 wherein the well contain devices which control or restrict the flow across a zone.

13. A method of characterizing a well using a series of measurements along the sandface of said well to optimize a well model, comprising the steps of:

(a) providing at least one control device configured to alter flow characteristics of a production fluid in the well;

(b) providing a well model with a plurality of adjustable physical parameters;

(c) acquiring a plurality of sandface measurements establishing a data set;

(d) running the well model on a data processing apparatus with different combinations of the plurality of adjustable physical parameters until results from the well model substantially correlate to results from the data set;

(e) changing the setting of at least one flow control device and acquiring a new plurality of sandface measurements establishing a new data set; and (f) repeating steps (d) and (e).

14. The method of claim 13, further comprising setting the at least one control device at the earth's surface.

15. The method of claim 14, wherein at least one of the at least one control device is a choke.

16. The method of claim 13, further comprising setting the at least one control device in the well.

17. The method of claim 13, wherein the series of measurements are distributed temperature measurements made along an optical fiber.

18. The method of claim 13, further comprising:

automated pre-processing of the plurality of sandface measurements.

19. The method of claim 18, wherein the automated pre-processing step includes correcting for depth.

20. The method of claim 18, wherein the automated pre-processing step includes reducing sandface measurement data noise.

* * * * *